US012070094B2

(12) United States Patent
Bergenthal et al.

(10) Patent No.: US 12,070,094 B2
(45) Date of Patent: Aug. 27, 2024

(54) ROBOTIC MANNEQUIN

(71) Applicant: EUVEKA (SAS), Saint Marcel les Valence (FR)

(72) Inventors: Audrey Laure Bergenthal, Saint Marcel les Valence (FR); Willy Fourniol, Saint Marcel les Valence (FR)

(73) Assignee: EUVEKA (SAS), Saint Marcel les Valence (FR)

( * ) Notice: Subject to any disclaimer, the term of this patent is extended or adjusted under 35 U.S.C. 154(b) by 193 days.

(21) Appl. No.: 17/540,897

(22) Filed: Dec. 2, 2021

(65) Prior Publication Data

US 2022/0338587 A1 Oct. 27, 2022

(30) Foreign Application Priority Data

Apr. 23, 2021 (FR) ..... 2104231

(51) Int. Cl.
*A41H 5/01* (2006.01)

(52) U.S. Cl.
CPC ..... *A41H 5/01* (2013.01)

(58) Field of Classification Search
CPC ..... A41H 5/00; A41H 5/01; A47F 8/00
See application file for complete search history.

(56) References Cited

U.S. PATENT DOCUMENTS 1,102,596 A 7/1914 Levin
1,717,477 A 6/1929 Ufford
2,005,399 A 6/1935 Sterling
2,646,907 A * 7/1953 Clawsey ..... A41H 5/01 223/68
3,191,821 A * 6/1965 Levin ..... A41H 5/01 223/68
3,734,362 A * 5/1973 Arthur ..... A41H 5/01 223/68
4,493,445 A * 1/1985 Arthur ..... A41H 5/01 223/68
5,265,779 A * 11/1993 Jiang ..... A41H 5/01 223/66
6,196,429 B1 * 3/2001 Cavdek ..... A41H 5/00 223/66
8,186,546 B2 * 5/2012 Wang ..... A41H 5/01 223/74
9,498,011 B2 * 11/2016 Chan ..... A47F 8/00
2007/0275632 A1 11/2007 Barra et al.
2020/0008503 A1 * 1/2020 Nielson ..... A41H 5/02

FOREIGN PATENT DOCUMENTS

CN 105919202 A * 9/2016

OTHER PUBLICATIONS

French Search Report issued in corresponding French Application No. 2104231, dated Dec. 12, 2021, pp. 1-8, National Institute of Industrial Property, Courbevoie, France.

* cited by examiner

*Primary Examiner* — F Griffin Hall
(74) *Attorney, Agent, or Firm* — HAUPTMAN HAM, LLP

(57) ABSTRACT

A robotic mannequin including a frame and shells that are movable with respect to the frame. The plurality of shells has at least one set of articulated shells including at least one first shell and a second shell, kinematically coupled through a first kinematic connection authorizing a rotation. It includes at least one actuator configured to apply a movement of translation to one among at least the first shell, the second shell, or the first kinematic connection.

19 Claims, 10 Drawing Sheets

[Fig.1]
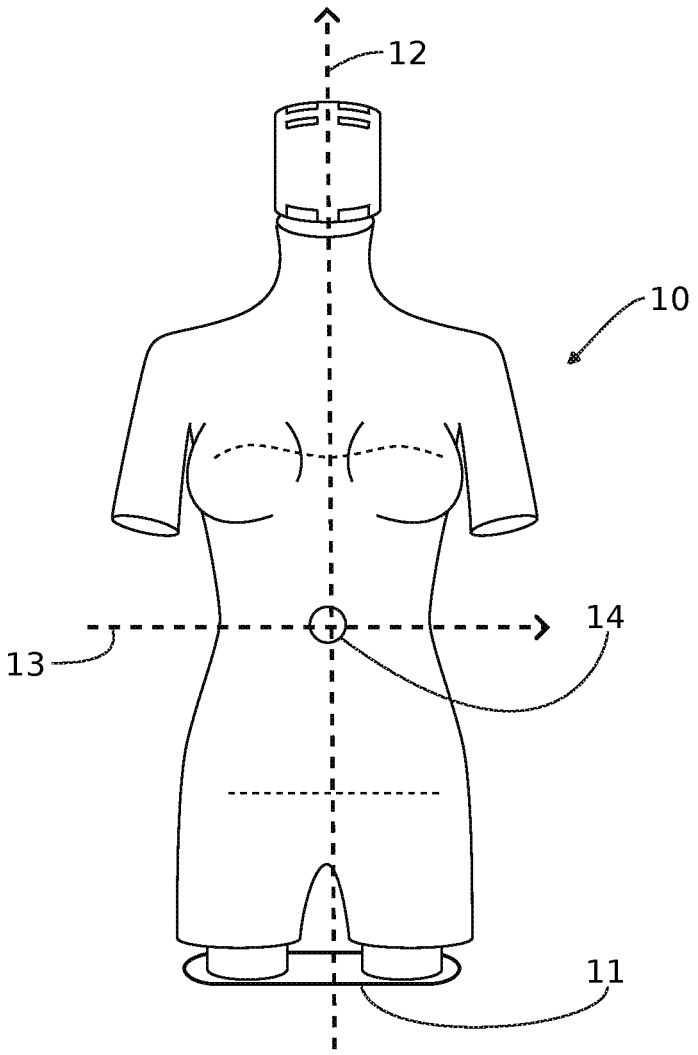

[Fig. 2]
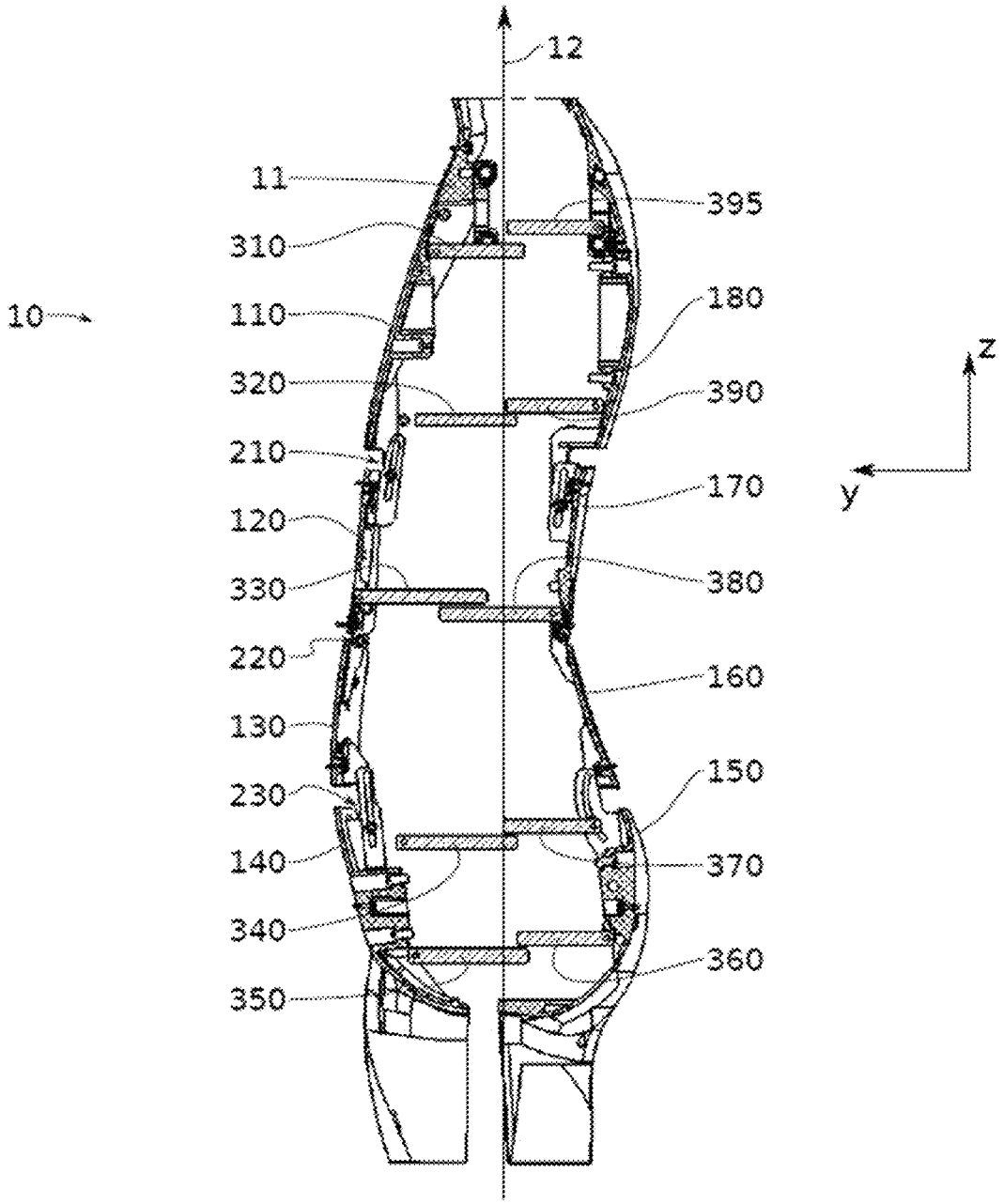

[Fig. 3]
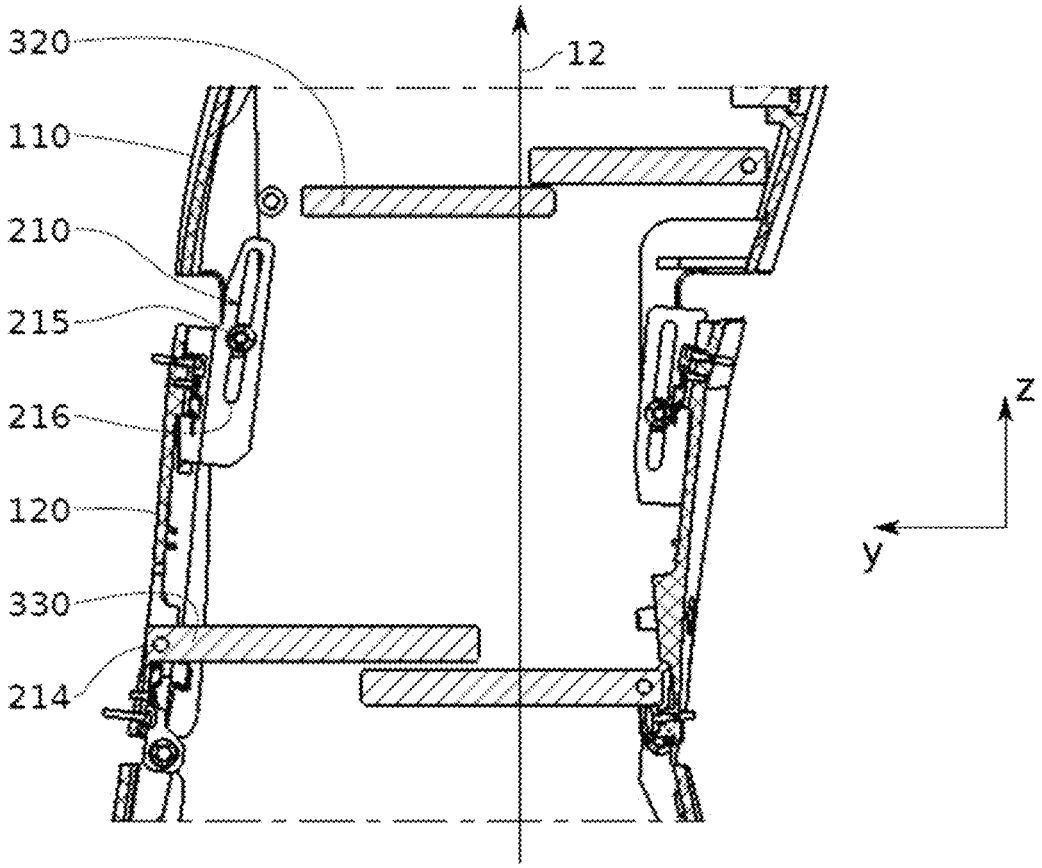

[Fig. 4]
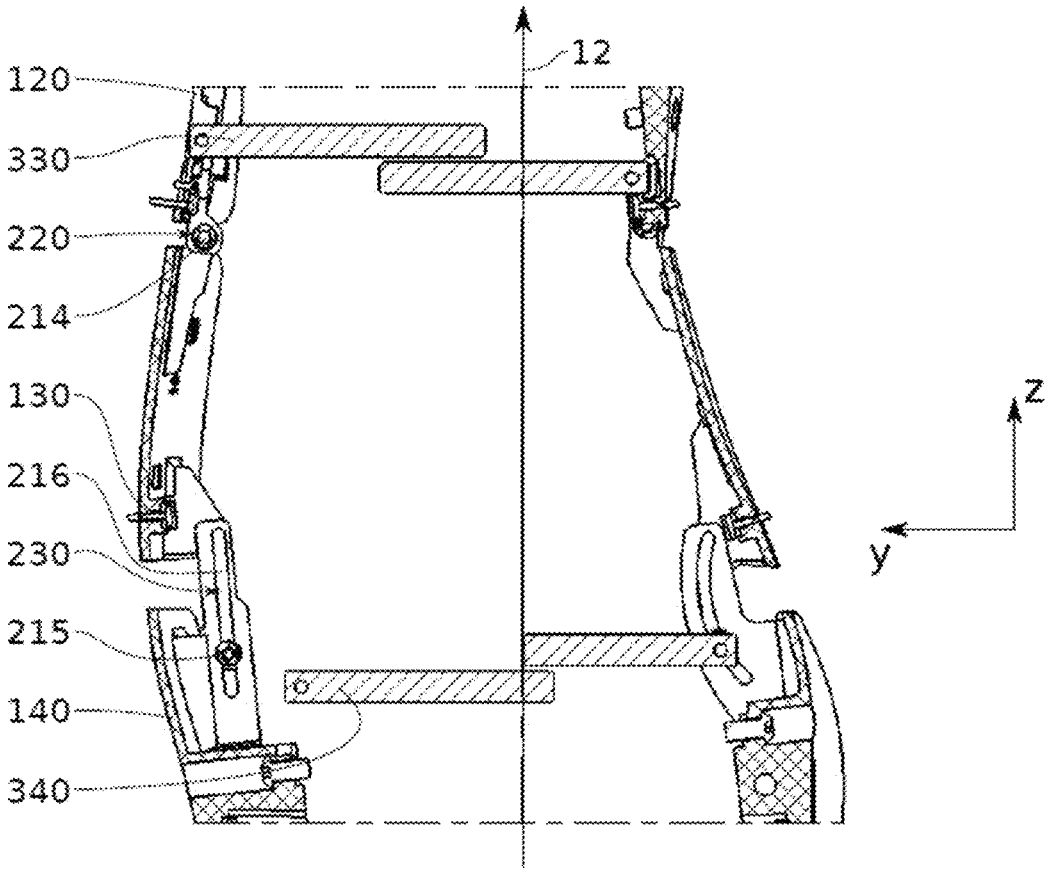

[Fig. 5]
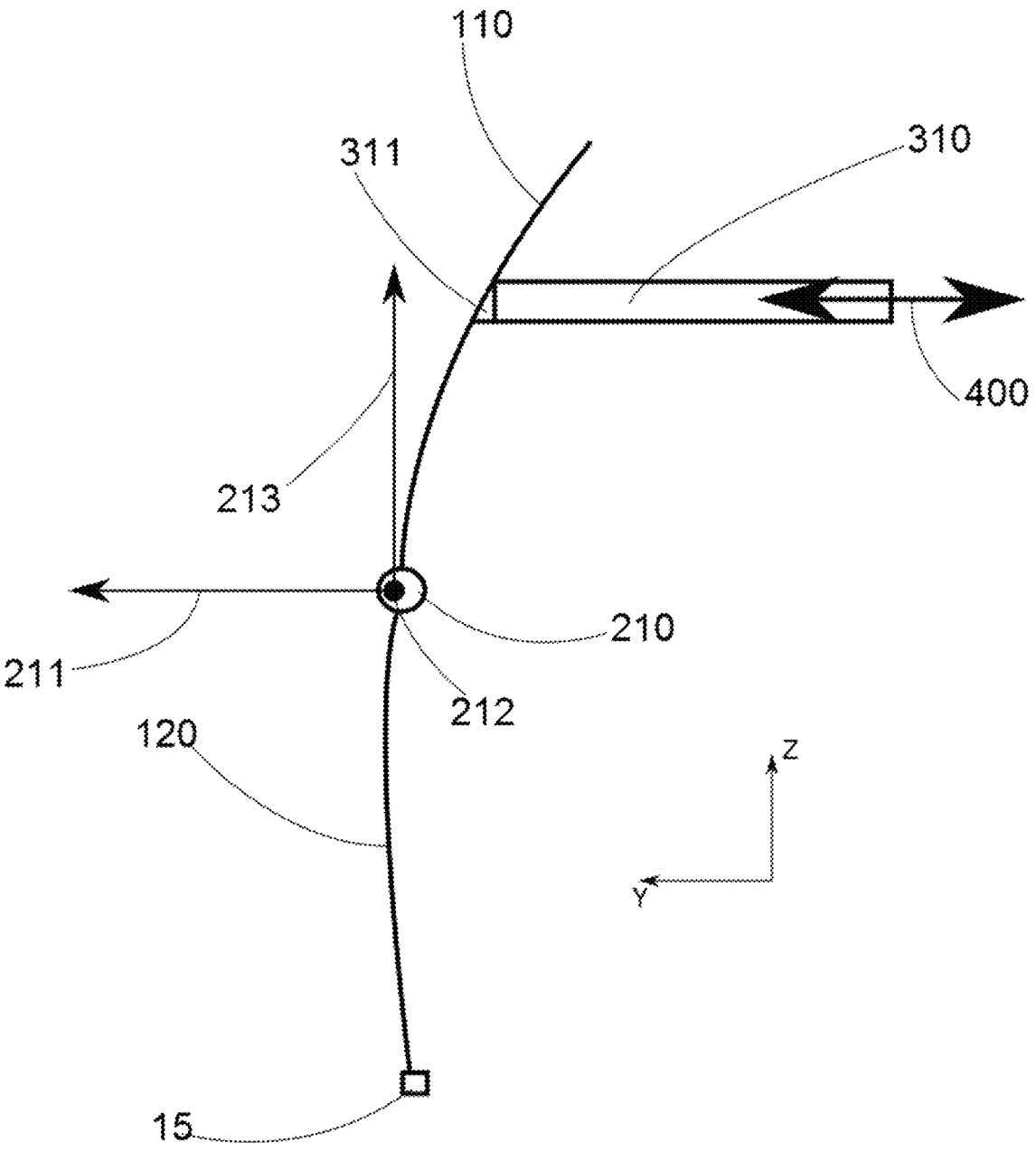

[Fig. 6]
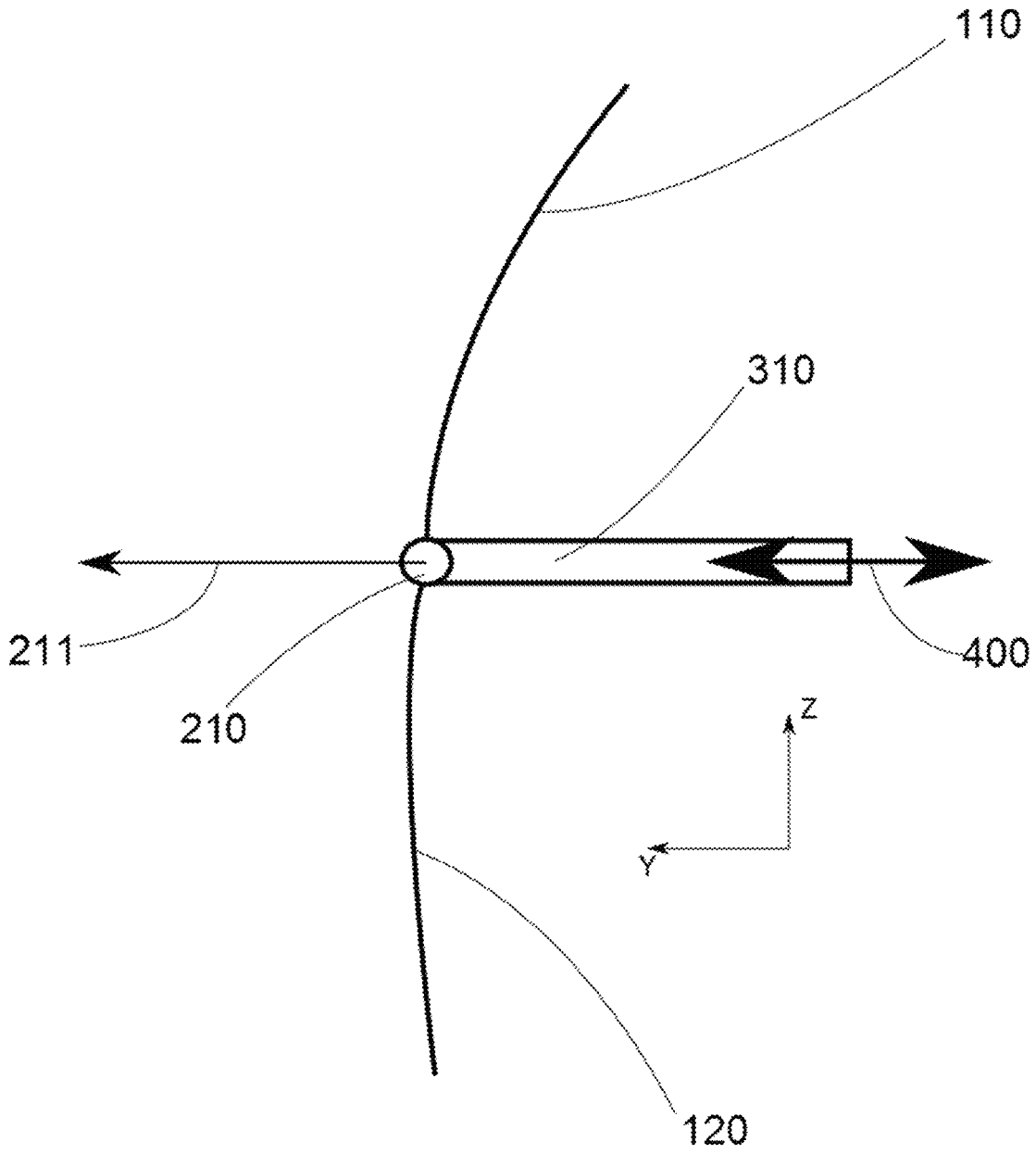

[Fig. 7]
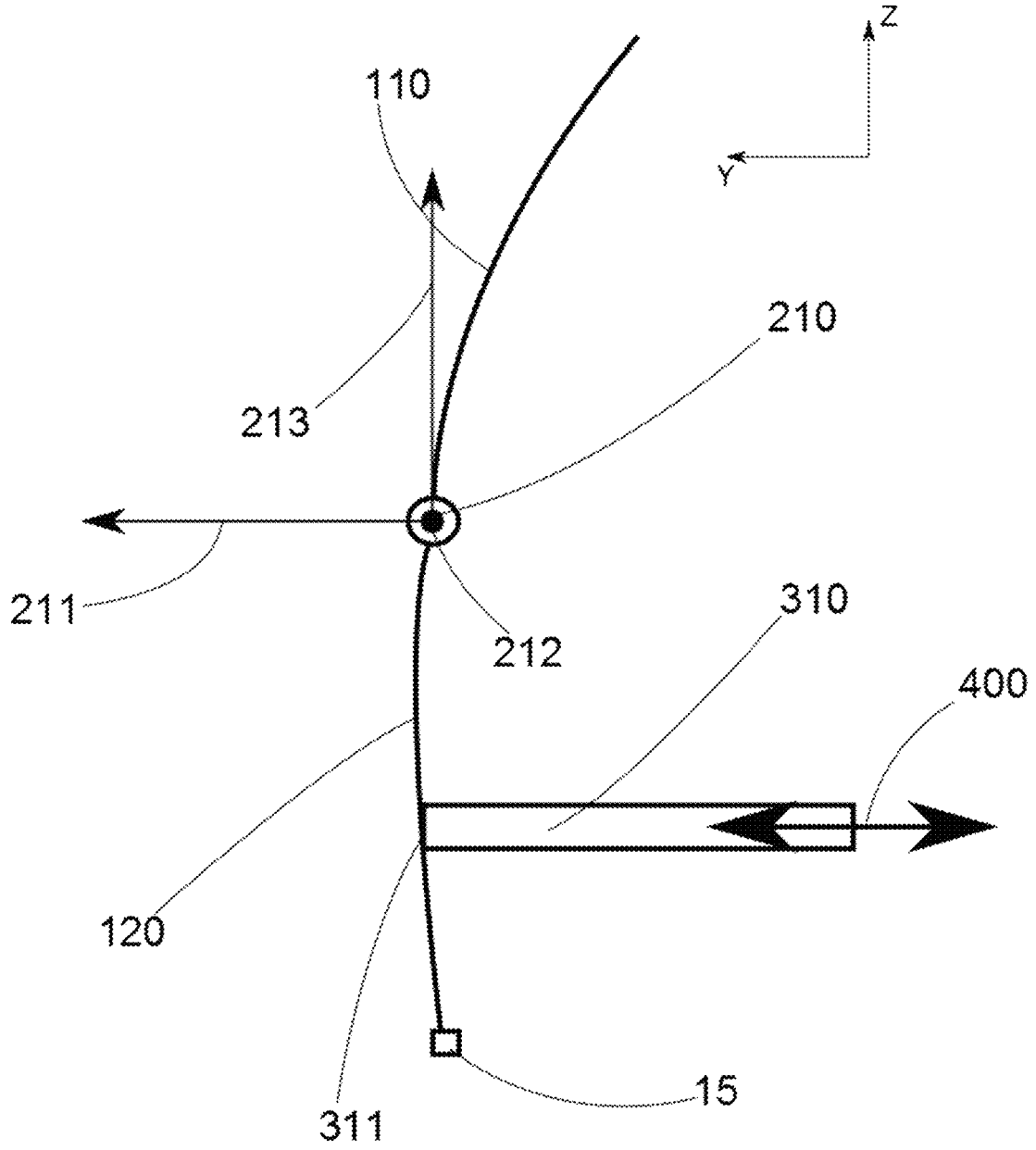

[Fig. 8]
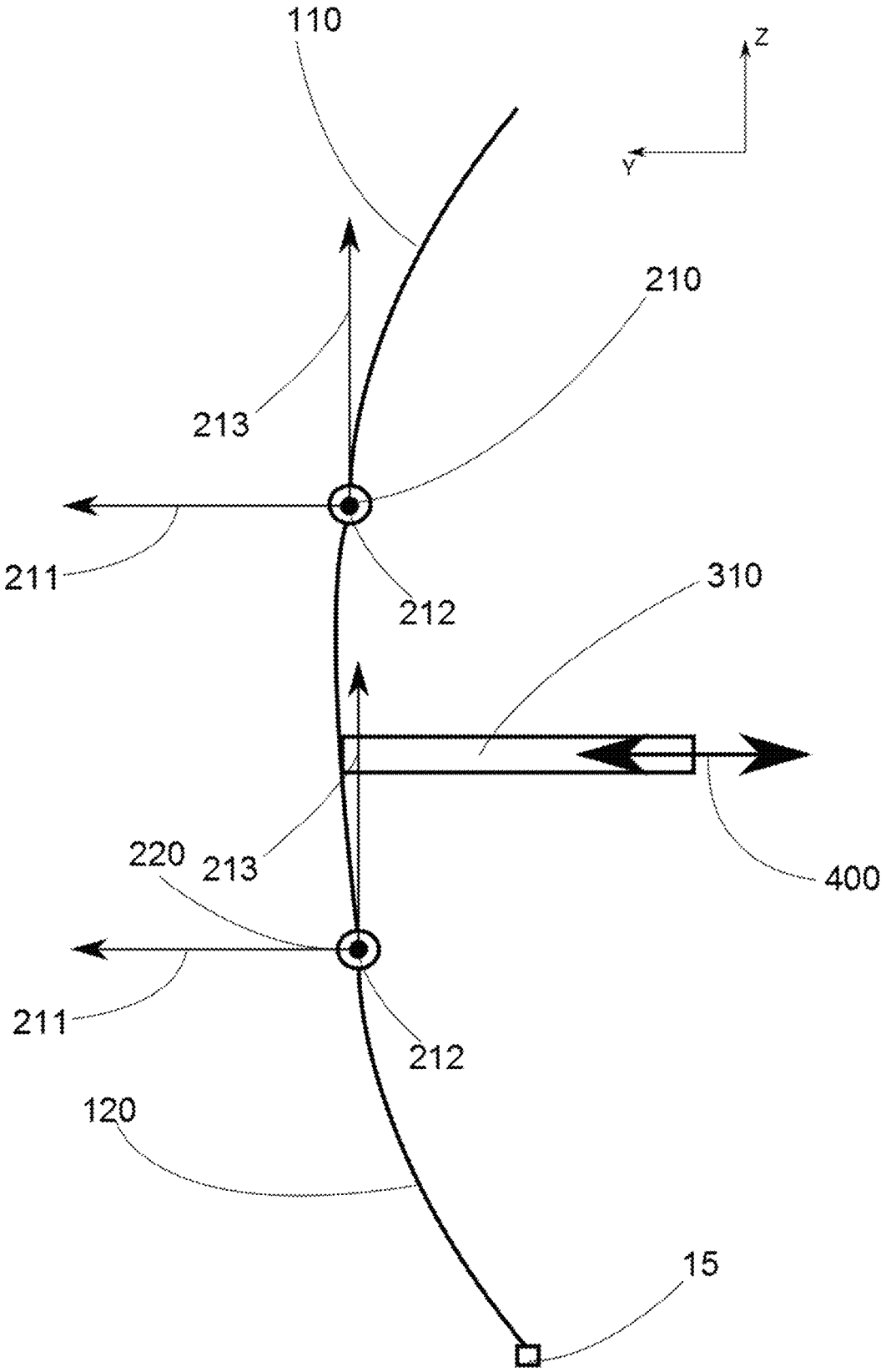

[Fig. 9]
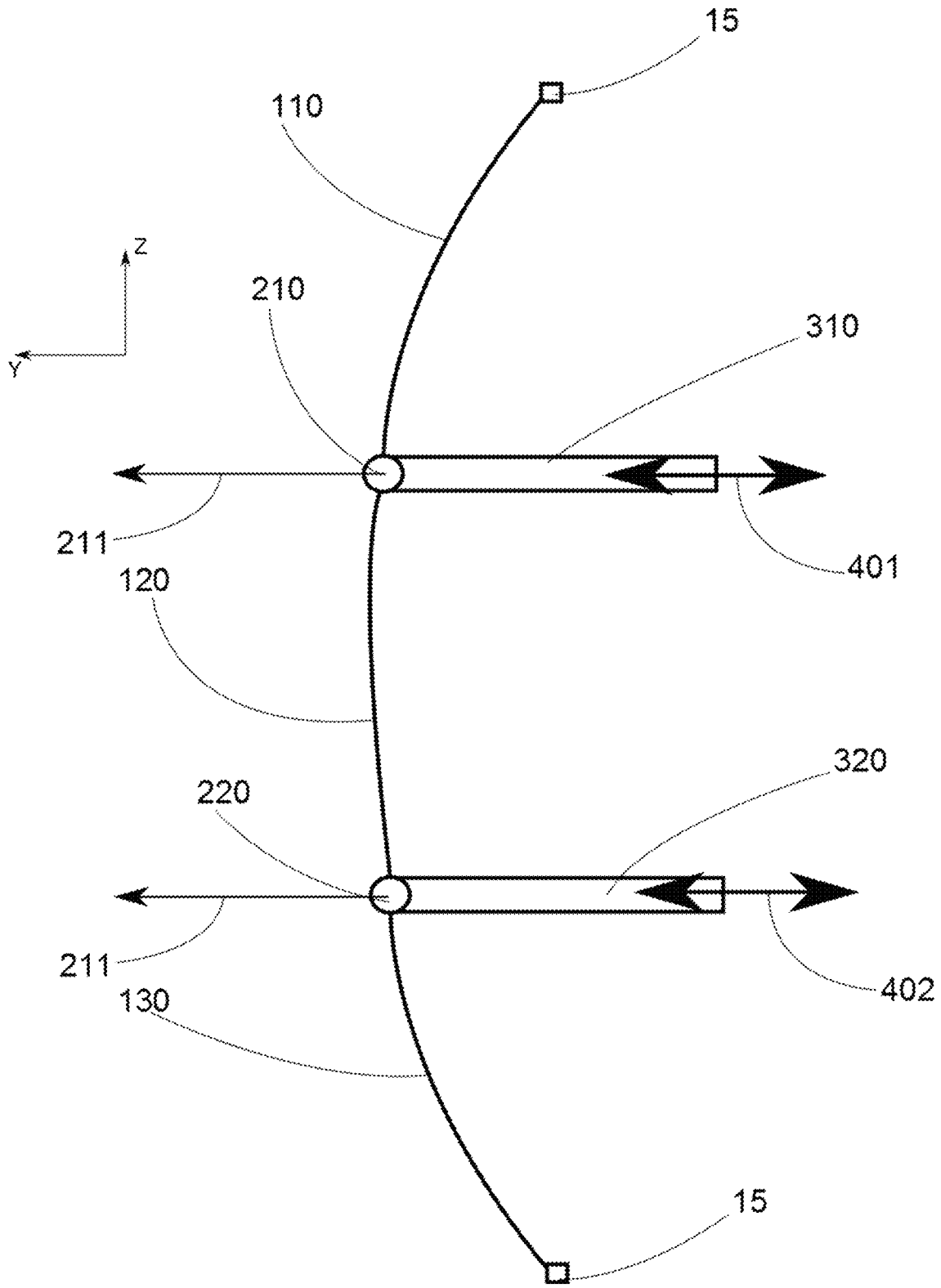

[Fig. 10]
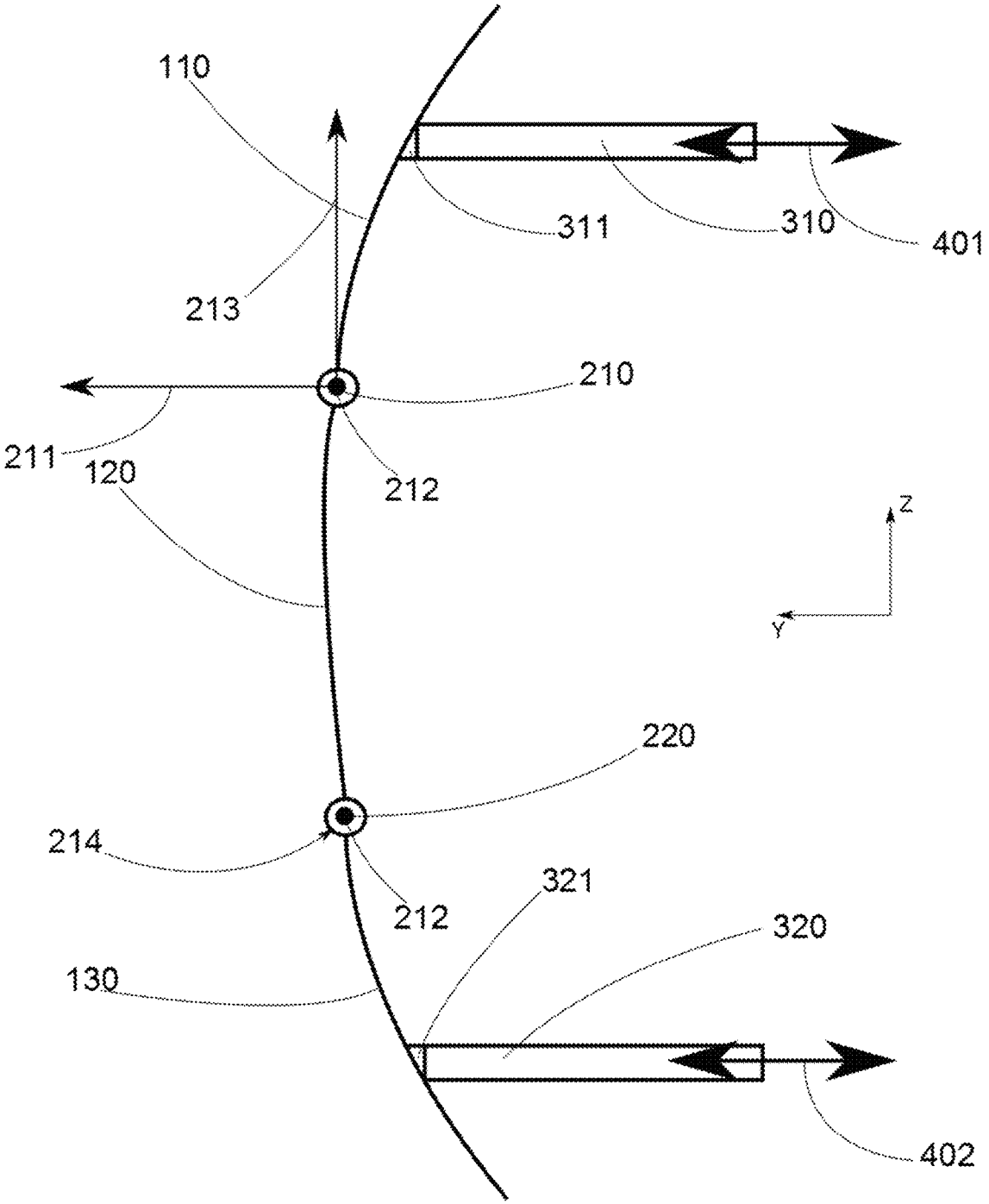

ROBOTIC MANNEQUIN

TECHNICAL FIELD

The invention relates to the field of robotic mannequins. It has for particularly advantageous application the field of sewing and clothes making.

PRIOR ART

For several years now, robotic mannequins have come to light. These mannequins are intended for the textile industry and are configured in such a way as to have in part at least one adaptable morphology.

Note for example mannequins of which certain parts are more or less inflatable so as to more or less enlarge the mannequin and thus have several morphologies on the same mannequin.

These robotic mannequins thus make it possible to reproduce at least partially certain measurements of an individual with more or less precision. This is made possible by mechanical parts with relative mobilities.

However one of the main disadvantages of these technologies resides in the continuity of the deformations of the mannequins and in the harmony of the body thus obtained. Indeed, these discontinuities in the morphology of the mannequin lead to substantial problems during the making of clothing.

Indeed, it is complex, even impossible, by adjusting the position of the movable elements forming the surface of the mannequin, to reproduce the harmony of the curves of a human body.

An object of the present invention is therefore to propose a solution to these problems.

The other objects, characteristics and advantages of the present invention shall appear when examining the following description and accompanying drawings. It is understood that other advantages can be incorporated.

SUMMARY

An aspect of the invention relates to a robotic mannequin that has a longitudinal dimension extending according to a longitudinal axis corresponding to a dimension in height of an individual and comprising at least one frame and a plurality of shells extending over at least one portion of said frame and being movable with respect to said frame, said robotic mannequin being able to reproduce on demand at least partially the morphology of an individual by mechanically controlling the plurality of shells, the robotic mannequin being characterised in that:

the plurality of shells has at least one set of articulated shells comprising at least one first shell and a second shell, wherein said first shell and said second shell are kinetically coupled to one another through at least one first kinematic connection;

said first kinematic connection has at least one degree of freedom according to a first axis of rotation;

It comprises at least one first actuator configured to apply a movement of translation, according to a first axis of translation orthogonal to the first axis of rotation, to at least one among at least: the first shell, the second shell, the first kinematic connection.

The present invention makes it possible to harmonise the surface topography of the robotic mannequin. That is to say, the present invention makes it possible to harmonise the adaptive morphology of the robotic mannequin.

The kinematic coupling between several shells makes it possible to displace several shells simultaneously and according to degrees of freedom that allow for a harmonious displacement of the surface of the robotic mannequin relatively to human morphology.

The present invention allows for a multi-shell displacement in order to carry out human morphologies.

By disposing and by allocating the degrees of freedom adapted to each kinematic connection, the present invention makes it possible to easily reproduce with the robotic mannequin the morphology of an individual during weight gain or weight loss.

Another aspect of the invention relates to a system comprising at least one robotic mannequin and at least one electronic circuit for controlling the first actuator of said robotic mannequin, said electronic control circuit receiving control commands from at least one computer program product comprising instructions, that when they are carried out by at least one processor, sends a series of control commands to said electronic control circuit.

Another aspect relates to an electronic circuit for controlling at least one robotic mannequin according to the invention.

Another aspect of the invention also relates to a computer program product comprising instructions, that when they are carried out by at least one processor, sends a series of control commands to said electronic control circuit.

Another aspect of the invention relates to a continuous kinematic chain intended for forming in part at least the torso of a robotic mannequin by being disposed on a frame of said mannequin and comprising a plurality of shells comprising at least one first and a second shell in relation to said frame, the continuous kinematic chain being characterised in that:

Said first shell and said second shell are mechanically coupled to one another through at least one first kinematic connection;

Said first kinematic connection is configured to be movable relatively to said frame according to at least:

i. A first axis of translation;

ii. A first axis of rotation orthogonal to said first axis of translation.

BRIEF DESCRIPTION OF THE DRAWINGS

The purposes and objects as well as the characteristics and advantages of the invention shall appear better in the detailed description of an embodiment of the latter which is shown in the following accompanying drawings wherein:

FIG. 1 shows a schematic view of a robotic mannequin according to an embodiment of the present invention.

FIG. 2 shows a cross-section and profile view according to the longitudinal axis of the robotic mannequin according to an embodiment of the present invention.

FIG. 3 shows an enlargement of the cross-section view of FIG. 2.

FIG. 4 shows an enlargement of the cross-section view of FIG. 2.

FIG. 5 shows a schematic view of a kinematic connection mechanically coupling two shells according to an embodiment of the present invention.

FIG. 6 shows a schematic view of a kinematic connection mechanically coupling two shells according to another embodiment of the present invention.

FIG. 7 shows a schematic view of a kinematic connection mechanically coupling two shells according to another embodiment of the present invention.

FIG. 8 shows a schematic view of two kinematic connections mechanically coupling three shells according to an embodiment of the present invention.

FIG. 9 shows a schematic view of two kinematic connections mechanically coupling three shells according to an embodiment of the present invention.

FIG. 10 shows a schematic view of two kinematic connections mechanically coupling three shells according to an embodiment of the present invention.

The drawings are given by way of examples and do not limit the invention. They form schematic block representations intended to facilitate the comprehension of the invention and are not necessarily to the scale of practical applications.

DETAILED DESCRIPTION OF THE INVENTION

Before beginning a detailed review of embodiments of the invention, optional characteristics are mentioned hereinafter that can optionally be used in association or alternatively.

The present invention makes it possible to harmonise the adaptive morphology of the robotic mannequin.

The kinematic coupling between several shells makes it possible to displace several shells simultaneously and according to degrees of freedom that allow for a harmonious displacement of the surface of the robotic mannequin relatively to human morphology The multi-shell displacement makes it possible to carry out human morphologies.

By disposing and by allocating the degrees of freedom adapted to each kinematic connection, this makes it possible to easily reproduce with the robotic mannequin the morphology of an individual during weight gain or weight loss.

the first axis of translation 211 is carried by a plane transverse to the longitudinal axis 12, and the first axis of rotation 212 is carried by a plane transverse to the longitudinal axis 12.

the first 110 and the second 120 shell are configured to vary the cross-sectional dimension of the outer surface of the robotic mannequin 10 in at least one plane transverse to the longitudinal axis 12.

the first actuator 310 is configured to apply said movement of translation only according to the first axis of translation 211.

the first kinematic connection 210 comprises a pivot connection 214 between the first 110 and the second 120 shells, said pivot connection 214 being movable in rotation about the first axis of rotation 212.

This makes it possible to kinematically link about an axis of rotation the displacement of the first shell with that of the second shell and inversely.

the first kinematic connection 210 has a second degree of freedom according to a second axis of translation 211, 213 orthogonal to the first axis of rotation 212.

This makes it possible to have a higher number of degrees of freedom in the displacement of the shells.

The first kinematic connection comprises a sliding pivot connection 215 between the first 110 and the second shells 120, said sliding pivot connection 215 being movable in rotation about the first axis of rotation 212 and in translation according to the second axis of translation 211, 213.

This makes it possible to kinematically link about an axis of rotation and according to an axis of translation the displacement of the first shell with that of the second shell and inversely.

At least one second actuator 320 is configured to apply a movement of translation according to the first axis of translation 211 to at least one among at least: the first shell 110, the second shell 120, the first kinematic connection 210.

This makes it possible to more adroitly control the morphology of the robotic mannequin.

The plurality of shells defines in part at least one continuous kinematic chain extending over a portion at least of the torso of the robotic mannequin 10.

This makes it possible to easily control a set of shells by controlling only certain points of the kinematic chain.

At least one among the first shell 110 and the second shell 120 is mechanically coupled to the frame 11 of the robotic mannequin 10 through at least one pivot connection 15 having at least one degree of freedom in rotation about the first axis of rotation 212.

This makes it possible to define a limit to the displacement of the end of a kinematic chain for example.

The first kinematic connection 210 is an elastic connection comprising a first return element.

This makes it possible to have many degrees of freedom.

The set of articulated shells comprises at least one third shell 130 kinematically coupled to at least one among the first 110 and the second 120 shell through at least one second kinematic connection 220.

This makes it possible to improve the resemblance between the morphology of the robotic mannequin and that of humans.

The second kinematic connection 220 comprises a number of degrees of freedom less than or equal to the number of degrees of freedom of the first kinematic connection 210.

The second kinematic connection 220 has a single degree of freedom according to the first axis of rotation 212.

This makes it possible to have a fixed point in translation according to an axis parallel to the longitudinal axis of the robotic mannequin.

The first kinematic connection 210 and the second kinematic connection 220 are disposed on either side of the first actuator 310.

The second kinematic connection 220 is an elastic connection comprising a second return element.

Said set of articulated shells comprises a third 130 and a fourth 140 shells, the third shell 130 being kinematically coupled to the second shell 120 by at least one second kinematic connection 220 and the fourth shell 140 being kinematically coupled to the third shell 130 by at least one third kinematic connection 230 wherein the first 210 and the third 230 kinematic connections have the same number of degrees of freedom, and preferably the same degrees of freedom, and wherein the second kinematic connection 220 has a number of degrees of freedom less than the number of degrees of freedom of the first 210 and of the third 230 kinematic connection and wherein the first 210 and the third 230 kinematic connection are disposed on either side of the second kinematic connection 220.

The second kinematic connection 220 is disposed at the waist of the robotic mannequin 10.

The set of articulated shells extends mainly according to the longitudinal axis 12 of the robotic mannequin 10.

The robotic mannequin 10 comprises a plurality of sets of juxtaposed articulated shells.

At least two sets of articulated shells of the plurality of sets of articulated shells are kinematically coupled to one another.

The robotic mannequin 10 comprises at least one actuator 310, 320, 330, 340, 350, 360, 370, 380, 390, 395 configured to apply at least one movement of translation to at least one shell 110, 120, 130, 140, 150, 160, 170.

The present invention relates to a robotic mannequin comprising a frame and at least one plurality of shells extending over at least one portion of the frame and of which at least some are movable relatively to the frame. This mobility thus makes it possible to modify the morphology of the robotic mannequin.

In an ingenious way, and so as to reproduce the harmony of the human silhouette, at least one portion of the shells are kinematically coupled together by one or more kinematic connections that shall be described in more length in what follows.

According to a preferred embodiment, a portion at least of the plurality of shells forms a continuous kinematic chain wherein each shell is kinematically coupled to at least one other shell by one or more kinematic connections. This is then referred to as sets of articulated shells.

Thus, astutely, the robotic mannequin comprises one and more preferably a plurality of sets of articulated shells.

The present invention makes it possible, via a kinematic coupling between several shells, to adjust a plurality of shells by displacing for example a single actuator applying a movement of displacement typically on a shell or on a kinematic connection.

The term "kinematic coupling" means a mechanical coupling that makes it possible to transfer at least one portion of a displacement in space between a first element and a second element.

The present invention shall now be described according to several embodiments through FIGS. 1 to 10.

FIG. 1 shows a schematic and general view of a robotic mannequin 10 according to an embodiment of the present invention.

This robotic mannequin 10 comprises at least one frame 11 extending more preferably according to the longitudinal axis 12 of the robotic mannequin 10 and more preferably configured to carry at least partially, more preferably entirely, a plurality of shells.

In the figures described, the longitudinal axis 12 of the robotic mannequin 10 is parallel to the axis z, the axis transversal 13 of the robotic mannequin 10 is parallel to the X axis and finally the anterior-posterior axis 14 of the robotic mannequin 10 is parallel to the Y axis.

In this example, the mannequin comprises six sets of shells, these sets being juxtaposed in x in the direction z, with for this example, three front sets and three rear sets, respectively representing an abutment zone and a back zone of the mannequin. Still by way of example, FIG. 1 shows sets of four articulated shells in series along the axis z. Two shoulder shells complete these sets and ensure an adjustment in height.

FIG. 2 shows a cross-section view according to the plane Y-Z of a robotic mannequin 10 according to an embodiment of the present invention.

This figure schematically shows the inside of the robotic mannequin 10. Note a plurality of shells (110, 120, 130, 140, 150, 160, 170, 180) movable relatively to the frame 11, as well as a plurality of actuators (310, 320, 330, 340, 350, 360, 370, 380, 390, 395) configured to displace said plurality of shells (110, 120, 130, 140, 150, 160, 170, 180). Thus for example the seventh actuator 370 is configured to displace the sixth shell 160.

Note on this figure that the robotic mannequin 10 has the capacity of seeing its morphology modified both on its front portion, but also on its rear portion.

Preferably, all the morphology of the robotic mannequin can be modified.

This figure also shows a plurality of kinematic connections (210, 220, 230) kinematically coupling between them a portion of the plurality of shells.

Certain connections are detailed in FIGS. 3 and 4. Generally, the sets shown in FIG. 2 (front and rear) each include four shells. The kinematic connections between shells can be distributed as follows:

the connection 220, in the vicinity of the actuator 330 can be located at the waist and can hardly be displaced along z. It is more preferably a pivot;

upwards, the connection 210 releases an additional translation to allow for the clearance in height for the two shells about the point 220;

downwards, a connection 230 provide a function similar to that of the connection 210, but below the connection 220;

the size can be adjusted by the actuator 330;

a pair of actuators 310, 320, drive the upper shell, allow for an adjustable inclination of the latter, by varying the displacements in translation of the rode of the actuators;

symmetrically, a pair of actuators 340, 350 modifies the inclination and the lateral amplitude of the lower shell, shell 140;

an intermediate shell, here shell 130 is not directly driven by any actuator;

arrangements similar to the preceding ones (for the front) are taken for the rear of the mannequin.

FIG. 3 shows an enlargement of a portion of FIG. 2. In this figure, the first shell 110 is kinetically coupled to the second shell 120 through the first kinematic connection 210.

Advantageously, this first kinematic connection 210 comprises a sliding pivot connection 215 configured to be displaced in a slide 216. Astutely, when the second actuator 320 drives (more preferably pushes towards the front or pulls towards the rear according to the anterior-posterior axis 14 of the robotic mannequin 10) the first shell 110, this first kinematic connection 210 is configured so that the second shell 120 is also driven in displacement.

Advantageously, this first kinematic connection 210 comprises at least two degrees of freedom. Preferably, this first kinematic connection 210 comprises a first degree of freedom according to the first axis of rotation 212 of the sliding pivot connection 215. This axis of rotation 212 is parallel, more preferably, to the axis transversal 14 of the robotic mannequin 10, i.e. parallel to the X axis.

Advantageously, and generally, the actuators (310, 320, 330, 340, 350, 360, 370, 380, 390, 395) each apply at least one movement of translation according to an axis of translation carried by a plane transverse to the longitudinal axis 12, i.e. by a plane parallel to the plane X-Y.

According to an embodiment, this first kinematic connection 210 comprises a second degree of freedom according to an axis parallel to the longitudinal axis 12, i.e. parallel to the axis Z. This degree of freedom corresponds to the sliding of the sliding pivot 215 in the slide 216. Preferably, the sliding of the sliding pivot 215 in the slide 216 comprises a non-zero component according to an axis parallel to the longitudinal axis 12.

According to another embodiment, the sliding of the sliding pivot 215 can be done according to another axis of translation.

In an ingenious way, it is in particular the combination of these two degrees of freedom that allow for the kinematic coupling between the first shell 110 and the second shell 120 in such a way as top allow for a modification of the morphology of the robotic mannequin 10.

Thus when the first shell 110 is displaced, a portion of its movement is transmitted to the second shell 120 by means of the first kinematic connection 210 and inversely.

This kinematic coupling allows the first shell 110 and the second shell 120 to have a surface, i.e. a topographical profile, that can be displaced in the three directions of space.

According to an embodiment, such as shown in FIG. 3, the first kinematic connection 210 comprises a first portion mechanically engaged with the first shell 110 and more preferably with the second actuator 320, and a second portion mechanically engaged with the second shell 120.

Also note on this figure the third actuator 330 configured to drive (more preferably to push towards the front or to pull towards the rear according to the anterior-posterior axis 14 of the robotic mannequin 10) the second shell 120. The second shell 120 is more preferably kinematically coupled via the first kinematic connection 210 with the first shell 110 in such a way that the displacement of the first shell 110 drives the second shell 120.

Note that the kinematic coupling by the first kinematic connection 210 transmits to the second shell 120 in part at least some components of the displacement of the first shell 110 convoluted with the degrees of freedom of the first kinematic connection 210.

In this figure, and according to a preferred embodiment, the third actuator 330 is mechanical engaged with the second shell 120 through a pivot connection 214.

Preferably, the transmission of thrust between the actuator 330 and the shell 120 is located in the vicinity of the connection 220 in order to have a substantial effect on the waist of the mannequin. It can be located in the lower fourth, even lower eighth of the height of the shell 120.

FIG. 4 shows an enlargement of a portion of FIG. 2. This figure shows the second shell 120 kinematically coupled with the third shell 130 through the second kinematic connection 220 comprising the pivot connection 214. This pivot connection 214 has, according to an embodiment, only a single degree of freedom in rotation about an axis parallel to the axis transversal 13 of the robotic mannequin, i.e. about an axis parallel to the X axis.

Advantageously, the third shell 130 is kinematically coupled with the fourth shell 140 through the third kinematic connection 230. The third kinematic connection 230 more preferably comprises a sliding pivot connection 215 configured to be displaced in a slide 216.

According to a preferred embodiment, the third kinematic connection 230 has the same technical characteristics and degrees of freedom as the first kinematic connection 210.

Advantageously the first 210 and the third 230 kinematic connections include a number of degrees of freedom greater than the number of degrees of freedom that the second kinematic connection 220 comprises.

Thus, through FIGS. 3 and 4, note that the first 110, second 120 and third 130 shells form a continuous kinematic chain comprising at least three kinematic connections (210, 220, 230), of which at least two comprising a sliding pivot connection 215 and at least one comprising a single pivot connection 214. This continuous kinematic chain is then movable relatively to the frame 11 of the robotic mannequin 10 via the use of at least one actuator, more preferably of at least two actuators, and advantageously of at least three actuators.

FIGS. 5 to 10 described hereinafter show non-limiting embodiments of the present invention. These are schematic representations of the kinematic coupling between two or three shells 110, 120, 130.

FIG. 5 shows the kinematic coupling between two shells. In this figure, the first shell 110 is kinematically coupled to the second shell 120 through the first kinematic connection 210.

As described hereinabove, the first kinematic connection 210 comprises at least two degrees of freedom of which one in translation according to the first axis of translation 213 and one in rotation according to the first axis of rotation 212.

More preferably the first kinematic connection 210 allows the first shell 110 and the second shell 120 to be movable in translation according to a displacement comprising a component according to the first axis of translation 211 and a component according to the second axis of translation 213.

Advantageously, the first axis of translation 211 is parallel to the Y axis and therefore to the anterior-posterior axis 14 of the robotic mannequin 10, and the second axis of translation 213 is parallel to the axis z and therefore to the longitudinal axis 12 of the robotic mannequin 10.

The displacement 400 of the first actuator 310 was also shown in this figure. According to an embodiment, the first actuator 310 is configured to produce a displacement according to the first axis of translation 211.

Advantageously, the first actuator 310 comprises an arm movable in translation according to the first axis of translation 211 in such a way as to push or pull the first shell 110 via a point of contact 311 between the first actuator 310 and the first shell 110. This point of contact 210 can include a pivot or not.

In this figure, and by way of a non-limiting example, the second shell 120 comprises a portion mechanically engaged with the first kinematic connection 210 and a portion mechanically engaged with the frame 11 through a zone of mechanical coupling 15 to the frame 11. This zone of mechanical coupling 15 can include a pivot for example defining a limit to the displacement of the second shell 120.

FIG. 6 shows another embodiment of the present invention, compatible with the preceding one, wherein the first shell 110 is again kinematically coupled to the second shell 120 through the first kinematic connection 210.

However, according to this embodiment, the first actuator 310 is mechanically engaged with the first kinematic connection 210 which is, here again, movable according to two degrees of freedom, one in rotation about the first axis of rotation 212 and the other in translation according to the second axis of translation 213. Note that the application by the first actuator 310 of a displacement in translation according to the first axis of translation 211 drives, via two degrees of freedom of the first kinematic connection 210, the displacement of the latter according to a translation according to the first axis of translation 211.

Thus, according to this embodiment, the first actuator 310 can pull or push the first kinematic connection 210 thus driving the first 110 and the second 120 shells.

According to an embodiment not shown, the first actuator 310 can have a mobility according to several degrees of freedom in such a way as to allows for the displacement of the first kinematic connection 210 according to several degrees of freedom in addition to the preceding ones mentioned with respect to this figure.

FIG. 7 shows another embodiment, similar to the one of FIG. 5. The first actuator 310 is here in mechanical contact at point of contact 311 with the second shell 120. This second shell 120 is on the one hand mechanically coupled to the frame 11 at the mechanical coupling point 15 and on the other hand kinematically coupled to the first shell 110 at the first kinematic connection 210.

Here again, the displacement of the first actuator 310 according to the Y axis drives the displacement of the first shell 110 according to a movement having a component according to the Y axis, as well as the displacement of the first kinematic connection 310 and of the first shell 110, both according to displacements that have components according to the Y axis.

FIG. 8 shows an embodiment of the present invention representing the first kinematic connection 210 kinematically coupling the first shell 110 with the second shell 120 and the second kinematic connection 220 kinematically coupling the second shell 120 with the third shell 130.

According to an example shown that is in no way limiting, the third shell 130 comprises a zone, more preferably an end, of mechanical coupling 15 with the frame 11 of the robotic mannequin 10.

According to FIG. 8, the first actuator 310 is disposed at the second shell 120. When the first actuator 310 is displaced according to the Y axis for example, this drives the displacement of the second shell 120 and by kinematic coupling with the first shell 110 and the third shell 130, the displacement of the first 110 and of the third 130 shells, this coupling being carried out by the first 210 and the second 220 kinematic connections.

According to an embodiment, the first 210 and the second 220 kinematic connections have the same number of degrees of freedom, and preferably the same types of degrees of freedom.

According to another embodiment, the first 210 and the second 220 kinematic connections have different degrees of freedom.

FIG. 9 shows an embodiment of the present invention wherein the first 110 and the third 130 shells each have a zone of mechanical coupling 15 with the frame 11 of the robotic mannequin 10.

In this figure, the first actuator 310 is in contact with the first kinematic connection 210, and the second actuator 320 is in contact with the second kinematic connection 220.

Identically to the embodiments described hereinabove, the displacement according to the Y axis of the first 310 and second 320 actuators drives the displacement of the first 110, second 120 and third 130 shells relatively to the frame 11.

FIG. 10 shows an embodiment substantially similar to the preceding one where the first 310 and second 320 actuators are disposed respectively in mechanical contact with the first 110 and the third 130 shells by means respectively of points of contact 311 and 321.

According to this embodiment, the second kinematic connection 220 comprises a pivot connection 214 and has a single degree of freedom. This single degree of freedom corresponds to a rotation about the first axis of rotation 212 parallel to the axis transversal 13 of robotic mannequin 10.

According to an embodiment, one or a plurality of kinematic connections can be of an elastic nature and thus include at least one or more return elements. In particular, an elastic link, such as an elastomer ring, can provide such a connection.

According to an embodiment, the actuators can be mechanical, hydraulic, electrical and/or pneumatic. Preferably, the design thereof is simplified by providing them with only a function of translation along a single axis, in a plane perpendicular to the axis 12 more preferably. The actuators are either punctually bearing against the shells, or are assembled with them, for example via a ball.

In an ingenious way, the present invention is not limited to a specific embodiment described in these figures. The present invention relates to any arrangement of shells kinematically coupled together by at least one kinematic connection.

Advantageously, the shells kinematically coupled together form sets of articulated shells. Thus, the robotic mannequin, according to an embodiment, is covered with sets of articulated shells, with certain sets of shells able, for example, to also be kinematically coupled together.

Generally, the kinematic connections can be disposed between the shells according to a vertical or horizontal alignment.

Generally, one or more shells can have a zone of mechanical coupling with the frame, this zone able to have or not one or more degrees of freedom.

Thus the present invention makes it possible to simultaneously displace several shells via a single actuator for example in such a way that the movement of the shells remains harmonious in relation to the silhouette of the robotic mannequin.

The kinematic coupling of the shells improves the topology harmony of the body of the robotic mannequin.

This kinematic coupling allows for a humanisation of the silhouette of the robotic mannequin.

In order to achieve a morphological harmony, it is advantageous to kinematically couple the shells together so as to respect the natural harmony and to thus bring the silhouette of the robotic mannequin as close as possible to that of a human.

Note finally that the present invention can be controlled via an electronic circuit and a control software configured to control the relative displacement of the shells in order to obtain a morphology desired by the user.

The invention is not limited to the embodiments described hereinabove and extends to all the embodiments covered by the claims.

LIST OF REFERENCES

10 Robotic mannequin
11 Armature
12 Axis longitudinal of the robotic mannequin
13 Axis transversal of the robotic mannequin
14 Anterior-posterior axis of the robotic mannequin
15 Zone of mechanical coupling with the frame
101 Kinematic chain
110 First shell
120 Second shell
130 Third shell
140 Fourth shell
150 Fifth shell
160 Sixth shell
170 Seventh shell
180 Eighth shell
210 First kinematic connection
211 First axis of translation
212 First axis of rotation
213 Second axis of translation
214 Pivot connection
215 Sliding pivot connection
216 Slide
220 Second kinematic connection
230 Third kinematic connection
310 First actuator
311 Point of contact of the first actuator
320 Second actuator
321 Point of contact of the second actuator
330 Third actuator

340 Fourth actuator
350 Fifth actuator
360 Sixth actuator
370 Seventh actuator
380 Eighth actuator
390 Ninth actuator
395 Tenth actuator
400 Movement of displacement
401 Movement of displacement of the first actuator
402 Movement of displacement of the second actuator

The invention claimed is:

1. A robotic mannequin having a longitudinal dimension extending according to a longitudinal axis corresponding to a dimension in height of an individual and comprising at least one frame and a plurality of shells extending over at least one portion of said frame and being movable with respect to said frame, said robotic mannequin being able to reproduce on demand at least partially a morphology of an individual by mechanically controlling the plurality of shells, wherein:

the plurality of shells has at least one set of articulated shells comprising at least one first shell and a second shell, wherein said at least one first shell and said second shell are kinetically coupled to one another through at least one first kinematic connection;

said at least one first kinematic connection has at least one degree of freedom according to a first axis of rotation;

the robotic mannequin comprising at least one first actuator configured to apply a movement of translation, according to a first axis of translation orthogonal to the first axis of rotation, to at least one among at least: the at least one first shell, the second shell, the at least one first kinematic connection; and the robotic mannequin comprising at least one second actuator, distinct from the at least one first actuator, configured to apply a movement of translation according to the first axis of translation to at least one among at least: the at least one first shell, the second shell, the at least one first kinematic connection.

2. The robotic mannequin according to claim 1 wherein the first axis of translation is carried by a plane transverse to the longitudinal axis, and wherein the first axis of rotation is carried by a plane transverse to the longitudinal axis.

3. The robotic mannequin according to claim 1 wherein the at least one first shell and the second shell are configured to vary the cross-sectional dimension of the outer surface of the robotic mannequin in at least one plane transverse to the longitudinal axis.

4. The robotic mannequin according to claim 1 wherein the at least one first actuator is configured to apply said movement of translation only according to the first axis of translation.

5. The robotic mannequin according to claim 1 wherein the at least one first kinematic connection comprises a pivot connection between the at least one first shell and the second shells, said pivot connection being movable in rotation about the first axis of rotation.

6. The robotic mannequin according to claim 1 wherein the at least one first kinematic connection has a second degree of freedom according to a second axis of translation orthogonal to the first axis of rotation.

7. The robotic mannequin according to claim 6 wherein the at least one first kinematic connection comprises a sliding pivot connection between the at least one first shell and the second shells, said sliding pivot connection being movable in rotation about the first axis of rotation and in translation according to the second axis of translation.

8. The robotic mannequin according to claim 1 wherein the plurality of shells defines partially at least one continuous kinematic chain extending over a portion at least of a torso of the robotic mannequin.

9. The robotic mannequin according to claim 1 wherein at least one among the at least one first shell and the second shell is mechanically coupled to the frame of the robotic mannequin through at least one pivot connection having at least one degree of freedom in rotation about the first axis of rotation.

10. The robotic mannequin according to claim 1 wherein the at least one first kinematic connection is an elastic connection comprising a first return element.

11. The robotic mannequin according to claim 1 wherein the set of articulated shells comprises at least one third shell kinematically coupled to at least one among the at least one first shell and the second shell through at least one second kinematic connection.

12. The robotic mannequin according to claim 11 wherein the second kinematic connection comprises a number of degrees of freedom less than or equal to a number of degrees of freedom of the at least one first kinematic connection.

13. The robotic mannequin according to claim 11 wherein the second kinematic connection has a single degree of freedom according to the first axis of rotation.

14. The robotic mannequin according to claim 11 wherein the at least one first kinematic connection and the second kinematic connection are disposed on either side of the first actuator.

15. The robotic mannequin according to claim 1 wherein said set of articulated shells comprises a third and a fourth shells, the third shell being kinematically coupled to the second shell by at least one second kinematic connection and the fourth shell being kinematically coupled to the third shell by at least one third kinematic connection wherein the first and the third kinematic connections having a same number of degrees of freedom, and preferably the same degrees of freedom, and wherein the second kinematic connection has a number of degrees of freedom less than the number of degrees of freedom of the first and of the third kinematic connection and wherein the first and the third kinematic connection are disposed on either side of the second kinematic connection.

16. The robotic mannequin according to claim 1 wherein the set of articulated shells extends mainly according to the longitudinal axis of the robotic mannequin.

17. The robotic mannequin according to claim 1 comprising a plurality of sets of juxtaposed articulated shells.

18. The robotic mannequin according to claim 17 wherein, at least two sets of articulated shells of the plurality of sets of articulated shells are kinematically coupled to one another.

19. The robotic mannequin according to claim 1 comprising at least one actuator configured to apply at least one movement of translation to at least one shell.

* * * * *